US005394907A

United States Patent [19]

Hjertman et al.

[11] Patent Number: 5,394,907

[45] Date of Patent: Mar. 7, 1995

[54] DEVICE AND METHOD FOR DOSING A LIQUID PRODUCT

[75] Inventors: Birger Hjertman, Vällingby; Gustav Levander, Bromma; Olle Ljungquist, Täby, all of Sweden

[73] Assignee: Pharmacia AB, Sweden

[21] Appl. No.: 952,829

[22] PCT Filed: Jun. 12, 1991

[86] PCT No.: PCT/SE91/00425

§ 371 Date: Nov. 30, 1992

§ 102(e) Date: Nov. 30, 1992

[87] PCT Pub. No.: WO92/01434

PCT Pub. Date: Feb. 6, 1992

[30] Foreign Application Priority Data

Jul. 19, 1990 [SE] Sweden ..... 9002468

[51] Int. Cl.[6] ..... A61J 1/12; B65B 9/12

[52] U.S. Cl. ..... 141/1; 141/114; 141/240; 141/330; 222/103; 222/105; 222/88; 604/410

[58] Field of Search ..... 141/1, 2, 9, 10, 18, 141/21, 25, 27, 100, 104, 114, 236, 238, 240, 329, 330; 53/474, 476, 480; 222/80, 81, 83, 5, 86, 88, 95, 103, 105, 129, 132; 604/407–416

[56] References Cited

U.S. PATENT DOCUMENTS

| | | | |
|---|---|---|---|
| 700,805 | 5/1902 | Paine | 206/528 |
| 3,257,072 | 6/1966 | Reynolds | 604/410 X |
| 3,987,961 | 10/1976 | Sinn et al. | 604/410 X |
| 4,131,217 | 12/1978 | Sandegren | 222/103 X |
| 4,522,622 | 6/1985 | Peery et al. | 604/410 X |
| 4,731,053 | 3/1988 | Hoffman | 604/410 X |
| 4,913,196 | 4/1990 | Williams et al. | 141/1 |

*Primary Examiner*—J. Casimer Jacyna

*Attorney, Agent, or Firm*—Pollock, Vande Sande & Priddy

[57] ABSTRACT

Device and method for dosing a liquid product from a tubular container are provided. The container includes a plurality of doses of the liquid product and a plate for pinching the container together locally such that it is divided into a plurality of separate liquid chambers containing a desired dose.

13 Claims, 2 Drawing Sheets

DEVICE AND METHOD FOR DOSING A LIQUID PRODUCT

TECHNICAL FIELD

This invention pertains to the field of the dosing of products, and more specifically to a device and a method for dosing a liquid product. Especially, the invention relates to such a device and method for the dosing of liquid pharmaceutical products for parenteral injection.

BACKGROUND ART

A number of devices for parenteral injection have been developed, which are intended to contain a plurality of doses of a pharmaceutical agent which are to be administered successively with appropriate intervals such devices have turned out to be very suitable in those cases when the patient has to administer the doses to himself, such as in the treatment of diabetes with insulin.

Injection devices of this type are often arranged to utilize an injection ampoule, which may be of the single-chamber or dual-chamber type. In preparing the device for injection, the user inserts the ampoule in the device and, in the case of a dual-chamber ampoule, carries out the necessary mixing of the contents of the two chambers. After this, the ampoule is connected to an injection needle, and a dose of the pharmaceutic agent is administered. The amount of the dose is determined by a suitable mechanism, often by controlling the stroke of the plunger in the injection ampoule. When the appropriate number of doses have been administered, the injection ampoule is removed and discarded, and a new ampoule may then be inserted.

As different patients require different doses of a pharmaceutical agent, it is necessary to use multi-dose injection devices where the dosage can be varied and the agent can be utilized with as little waste as possible. This is of special importance when very expensive agents are administered, such as certain hormones and proteins. If only one dose could be administered from each injection ampoule and the rest would go to waste, the cost of the treatment would be prohibitively high.

However, there exists a serious problem in the use of multi-dose injection devices. As the contents of the injection ampoule will get into some contact with the outside environment once the seal of the ampoule has been broken at the first administration, there is a certain risk for a contamination of the contents of the ampoule by microorganisms and viruses. This problem is aggravated by the fact that a new injection needle is usually connected to the device for each new administration.

It is of course necessary that sterility is maintained in the pharmaceutical agent during the whole period when it is present in the device and doses of the agent are drawn off to be administered. This object has usually been attained by the addition of preserving agents to the agent in the injection ampoule, such as methyl or propyl paraben and the like. The addition of such preserving agents, however, is not always acceptable, as they may have a detrimental effect on the pharmaceutic agent used. This is of special importance when very sensitive agents are used, such as those which have to be packed in a dual-chamber ampoule because of their sensitivity to harmful influences. For such pharmaceutical agents, the presence of preserving agents cannot usually be accepted.

The presence of preserving agents would not be necessary if each single dose of the pharmaceutic agent could be kept in a chamber separate from the other doses and would not get into contact with the outside environment until immediately before the administering of the agent. At the same time, it should be possible to arrange these chambers such that each of them contains the desired amount for the dose.

A further object of the invention is to arrange for two or more components of the pharmaceutic agent to be kept separate initially, and to mix said components before said chambers are arranged. These objects are attained by the present invention.

SUMMARY OF INVENTION

According to the present invention, a device for dosing a liquid product is provided, which is characterized in that it comprises a tubular container of a compliant material, which contains a plurality of doses of the liquid product, and means for pinching the container together locally such that it is divided into a plurality of separate liquid chambers, each of which containing a desired dose.

DESCRIPTION OF BEST AND VARIOUS MODES FOR CARRYING OUT INVENTION

Figure 1:
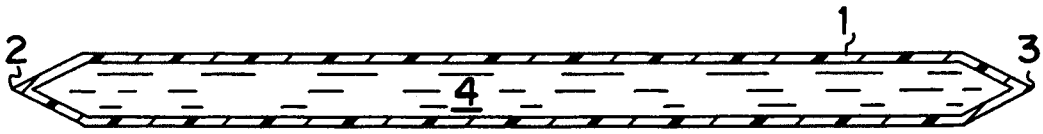
FIG. 1 is a sectional view illustrating a tubular container before it is divided up into separate doses.

In a preferred embodiment of the invention, the means for pinching the container together is a plate having a plurality of spaced projections, which are pressed against the container while it rests against a solid support, and thereby pinch the container together. It is also possible to provide both the plate and the support with matching spaced projections, which pinch the container together when the plate is pressed against the support.

In a further preferred embodiment, the tubular container is initially divided into two or more spaces, each of which containing a product, and the contents of each of these spaces have been combined together and mixed before the container has subsequently been pinched to form the separate liquid chambers.

The invention also refers to a method for dosing a liquid product, which is characterized in that a plurality of doses of the product is enclosed in a tubular container of a compliant material and said container is subsequently pinched together locally such that a plurality of separate liquid chambers are formed, each of said chambers containing a dose of the product, and the product is thereafter withdrawn as desired from each of said liquid chambers.

In a preferred embodiment of the invention, the tubular container is pinched between a solid support and a plate having a plurality of spaced projections, which pinch the container together locally. The solid support may also be provided with spaced projections, which match those of the plate.

In a further preferred embodiment of the invention, the tubular container is initially divided into two or more spaces and a product is enclosed in each of said spaces, and the spaces are united and their contents are mixed before the container is pinched together to form the liquid chambers.

The invention is further described in the following detailed specification in combination with the appended drawings, which are not intended to limit the scope of the invention in any way. In the figures of the drawing, equivalent elements have the same reference numbers.

Figure 2A:
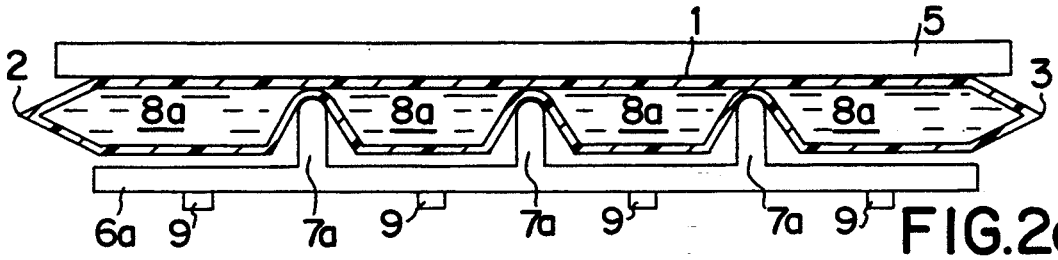
FIG. 2*a* and 2*b* are sectional views showing dividing of the tubular container into different doses.
Figure 2B:
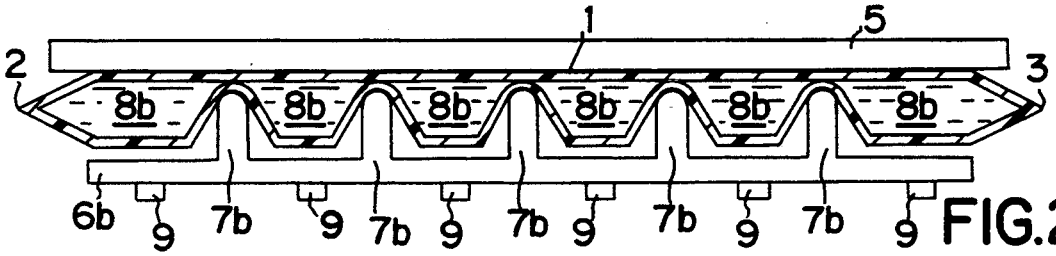
Figure 4:
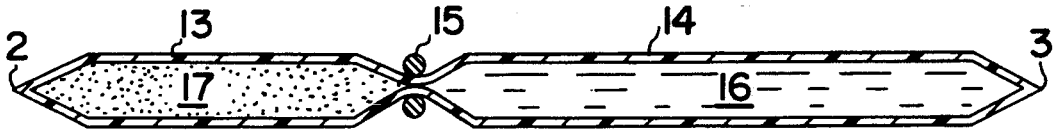
FIG. 4 is a sectional view showing how the tubular container may initially be divided into the separate spaces.
Figure 3:
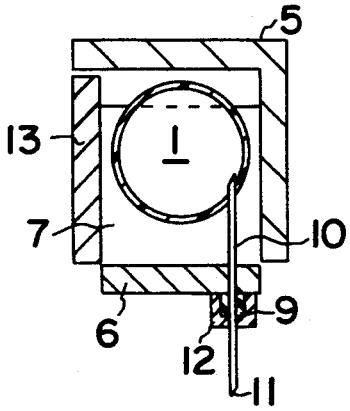
FIG. 3 is a schematic end view of an arrangement for withdrawing liquid from separate liquid chambers.

In the drawings, FIG. 1 shows a tubular container before it is divided up into separate doses. FIGS. 2*a* and 2*b* show the dividing of the tubular container into different doses. FIG. 3 shows an arrangement for withdrawing liquid from the separate liquid chambers. FIG. 4 shows how the tubular container may initially be divided into two separate spaces.

In the present specification and claims, the term "liquid" is intended to encompass pure liquids as well as solutions, emulsions and suspensions. The viscosities of such liquids may also vary within a wide range.

FIG. 1 schematically shows a sectional view of a tubular container to be used in the invention. The container 1 is made of a compliant material, such as a suitable plastic or rubber material. At its ends 2 and 3, the container is closed, for instance by heat sealing. Enclosed in the container 1 is a liquid 4. If it is intended to administer the liquid by parenteral injection, it is important that no air Or other gases are present inside the container. It is of course also of great importance that the liquid has been enclosed in the container under sterile conditions and that the liquid itself is sterile, so that there will be no risk of bacterial or viral contamination. For a person skilled in the art, there is no difficulty to ensure that these essential conditions are fulfilled.

FIGS. 2*a* and 2*b* show in sectional views how the container 1 may be divided into separate liquid chambers. The tubular container 1 here rests against a support plate 5 and a plate 6 having a plurality of spaced projections 7 is pressed against the container 1 such that it is pinched together between the support plate 5, and the projections 7. As a result of this pinching, the container 1 will be divided into a plurality of separate liquid chambers 8. It is essential that the pinching is carried out with such a force that the tubular container 1 is completely closed between the liquid chambers 8, so that no liquid or other matter can pass from one liquid chamber to the adjacent one. This can be attained by the use of some suitable squeezing device, such as a screw or clamp mechanism (not shown).

The amounts of the doses in the separate liquid chambers are determined by the spacing of the projections 7 on the plate 6. Thus it will be seen that in FIG. 2*a*, the plate 6*a* has three widely spaced projections 7*a*, which divide the container 1 into four liquid chambers 8*a*. In FIG. 2*b*, the plate 6*b* has five closely spaced projections 7*b*, which divide the container 1 into six liquid chambers 8*b*. Evidently, the dose in the liquid chambers 8*a* is greater than that in the liquid chambers 8*b*. Thus the same tubular container can be used for adminstering different doses, depending on the spacing of the projections 7. If the amount to be dosed is to be changed after a container has been used up, it is only necessary to use another plate 6 having an appropriate spacing between the projections 7. In this respect, the plate 6 with its projections 7 can be regarded as an "information carrier".

It is even possible that the spacing between the projections 7 on the plate 6 is not constant, for instance when the doses adminstered are to be progressively increased.

In a preferred embodiment, the projections 7 are shaped as spaced parallel ridges on a plate 6.

Preferably, the plate 6 is also provided with outlet connections 9, which are to be used when liquid is withdrawn from the liquid chambers 8. The connections may be arranged in a number corresponding to the number of liquid chambers 8 provided by the projections 7, so that each chamber has an appropriately located outlet connection. These outlet connections are described in more detail under FIG. 3. In a variant, it is possible to use only one outlet connection, which is movable along the plate 6 and can be fixed to the plate at an appropriate location for withdrawing liquid from one of the liquid chambers. The plate may, for example, be provided with holes at these locations, so that a connection with the liquid chamber in question is made possible.

FIG. 3 shows a schematic end view of the device of the invention. The tubular container 1 is resting against the support plate 5, which has an L-shaped section for fixing the container securely. The plate 6 with its projections 7 has been pressed against the container 1, so that the container is pinched together by the projections 7 against the support plate 5. The pinching is maintained by some suitable clamping device (not shown).

An outlet connection 9 is shown attached to the plate 6. This outlet connection may be threaded externally to receive an injection needle assembly 10, 11, 12. This assembly comprises a hollow needle which has a sharp point at both ends and where one part 10 of the needle is arranged to pierce the wall of the tubular container 1 at a selected liquid chamber, and the other end 11 of the needle is arranged to be used for a parenteral injection. This dual-pointed needle is mounted in a cap 12 which can be screwed onto the outlet connection 9, at the same time as the end 10 of the needle pierces the wall of the liquid chamber 8. The liquid in the chamber can then be drawn off through the needle and administered to a patient.

In a simpler embodiment, the outlet connection 9 may only provide an aperture through the plate 6. The needle of a conventional injection syringe may then be inserted through the aperture to pierce the wall of the container 1, so that the liquid in the liquid chamber may be drawn off in this way for a subsequent administration by means of the syringe.

In FIG. 3, the outlet connection 9 is shown in an off-center position, so that the needle for drawing off the liquid will pierce the wall of the container in an off-center position near its side. This is a preferred embodiment, as it makes it easier to squeeze out the contents of the liquid chamber completely, so that only a minimal amount of liquid is left in the chamber.

The device of the invention also preferably comprises a pressure plate 13. When the liquid is to be drawn off from the liquid chamber, the pressure plate 13 is urged inwards against the tubular container 1, so that the liquid chamber in question is squeezed against the support plate 5. This makes it possible to empty the liquid chamber essentially completely, so that all the liquid will be administered. The pressure plate has a size which fits in between the projections 7 on the plate 6, and it may consist of a number of individual pressure plates, one for each of the liquid chambers 8. It can also consist of one single plate which is arranged movable along the plate 6, as each one of the liquid chambers 8 is emptied in its turn.

FIG. 4 shows an embodiment of the invention where the liquid container is divided into two separate spaces 18 and 14 which each contain a constituent of the product to be administered. The container is initially the same as the container 1 in FIG. 1, but before it is filled, it is divided into two separate spaces by means of a suitable clamping device 15. The space 14 is then filled with the appropriate liquid constituent 16, and the space 18 is filled with a dry constituent 17 in the form of a powder. The ends 2 and 3 of the container are sealed in the same way as previously described. It is of course also possible to have two liquid constituents, one in each space, and even to arrange more than two spaces which are separated from each other by means of clamping devices.

The embodiment shown in FIG. 4 is suitable for compositions where the active constituent does not have a sufficient stability in a dissolved state. This is the case for certain sensitive hormone and protein preparations, for example. When the preparation is to be made ready for administration, the clamping device 15 is released, so that the two spaces 18 and 14 are united and the two constituents 16 and 17 may be mixed. The dissolution of a powder constituent 17 in a liquid constituent 16 can also be carried out with the necessary care to prevent that sensitive materials are denatured or in other ways degraded.

When a complete solution has been obtained, the liquid container, which now looks the same as that in FIG. 1, is placed on the support plate 5 and is pinched together by the projections 7 on the plate 6 in the same way as previously described. The administration of the liquid product can then be carried out as described previously.

It is of course also possible that the two constituents 16 and 17 do not form a solution when they are mixed, but instead form an emulsion or a suspension. Also, the liquid constituent 16 may itself be an emulsion or a suspension initially.

Figure 5:
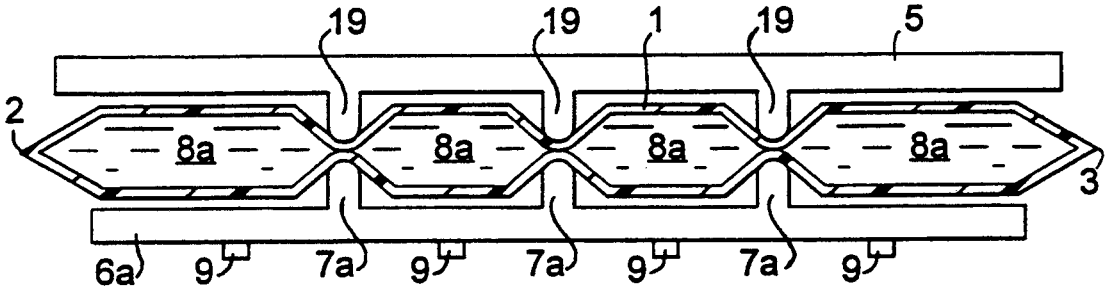
FIG. 5 is a sectional view showing how both the support and the plate may be provided with projections for pinching the tubular container together.

FIG. 5 shows an embodiment of the present invention where the support 5 and the plate **6*a* are both provided with projections for pinching the tubular container 1 together. The plate 6*a* is provided with projections 7*a* as shown in FIG. 2*a*. The support 5, however, is also provided with projections 19, which match the projections 7*a* such that they abut each other when the support 5 and the plate 6*a* are pressed together, and consequently pinch the tubular container 1 between them, dividing it into separate liquid chambers 8*a***.

When the liquid product has been administered from one of the liquid chambers, the double-pointed needle assembly 10, 11 is removed and discarded, and for the administration from the subsequent liquid chamber, a new sterile needle assembly is attached in the appropriate position. When all the liquid chambers have been emptied, the plate 6 with the projections 7 is loosened from the support plate 5, and the emptied tubular container 1 is discarded. A new tubular container 1 may then be arranged on the support plate 5 and pinched together by the projections 7 on the plate 6 as described previously.

The tubular container is preferrably made from a suitable plastic material which has the necessary compliance and elasticity, and which can preferably be heat sealed. A number of suitable material are known to persons skilled in the art, such as polyolefins, halogenated polyolefins, polyesters, polyamides and other materials which may be processed to suitable films and tubes. The plastic materials may contain conventional additives, such as plasticizers, stabilizers, pigments and the like, but it is of course essential that neither the plastic materials themselves nor the additives may exert any harmful influence on the product to be administered. Laminates of two or more plastic materials are also possible and are in many cases to be preferred, as they may give a suitable combination of desirable properties, such as impermeability and heat sealability. Preferably, the plastic materials should be resistent to sterilization by high temperature or ionizing radiation.

The support plate 5 and the information carrier plate 6 with its projections 7 can be made from some suitable metal or rigid plastic material. These parts do not come into contact with the liquid product to be administered, and they can therefore be re-used as-many times as desired. The selection of a suitable material lies within the competence of one skilled in the art.

Through the device and method of the invention, a number of important advantages are obtained. Even though a number of separate doses are to be drawn off from what is initially a single container, preserving agents are not necessary. After the pinching together of the tubular container into a number of separate liquid chambers, each containing a determined dose, the contents of one chamber cannot contaminate an adjacent chamber, as the chambers are sealingly closed off from each other.

At the same time, it is possible to administer different doses from tubular containers of the same size by using information carrier plates having a different spacing between the projections, and the same support plate for all dose amounts. The support plate and the information carrier plate may be reused as many times as desired, and only the tubular containers and the injection needles have to be discarded after use. It is also easy for the user himself to prepare injection preparations from two or more sensitive constituents, which are carefully mixed immediately before use by means of a multible-chamber container. This makes the device of the invention very suitable for use when the patient has to give frequent administrations of a pharmaceutical agent to himself, such as in the treatment of diabetes with insulin, or the treatment with growth hormone. By the use of the device and the method of the invention, the utilization of expensive pharmaceutical agents is made more efficient.

A further advantage is that the product in the tubular container may be enclosed under complete absence from air or other gases. This eliminates the risk that air or gases are administered by the injection.

Finally, both the tubular container and the information carrier plate and the support plate are of a simple design and can be fabricated by simple processes. This keeps the costs of the device low.

In the foregoing, the device and the method of the invention have been described with special reference to the administering of pharmaceutical agents. This is the preferred embodiment, but the invention is not restricted to this use only. The advantages of the invention can also be obtained in other uses, such as in the dosing of laboratory reagents, diagnostic agents and microbiological preparations.

Also, those skilled in the art will realize that the invention is not restricted to the embodiments shown in the drawings and described in conjunction therewith. A number of variants and modifications are possible within the scope of the appanded claims, as is clear to the expert.

What is claimed is:

1. A device for dosing a liquid pharmaceutical product, comprising a) a tubular container of a compliant material and a single chamber, which encloses a plurality of doses of said product in non-dosed form, and b) means for pinching said container together locally and simultaneously such that it is divided into more than two separate liquid chambers, each chamber containing a desired dose for administration to a patient and wherein said means for pinching the container together being a plate having a plurality of spaced projections, which are pressed against said container while it rests on a solid support.

2. The device of claim 1, characterized in that the solid support is provided with spaced projections which match those of the plate.

3. The device of claim 1, characterized in that the projections are shaped as parallel ridges on a plate.

4. The device of claim 1, characterized in that the means for pinching the container together is provided with one or more connections which are arranged such that a pointed tube may be introduced through the wall of each of the liquid chambers, for drawing off the liquid therein.

5. The device of claim 4, characterized in that each of the connections is arranged to be connected to an injection needle in liquid connection with the pointed tube.

6. The device of claim 1, characterized in that it is provided with means for squeezing out the liquid from each of the liquid chambers.

7. The device of claim 1, characterized in that the tubular container initially is divided into two or more spaces, each of which containing a product constituent, and that the constituents of these spaces have been combined together and mixed before said container has subsequently been pinched together to form the separate liquid chambers.

8. A method for dosing a liquid pharmaceutical product, comprising a) enclosing a plurality of doses of said product in non-dosed form in a tubular container of a compliant material and a single chamber and b) subsequently pinching together said container between a solid support and a plate having a plurality of spaced projections, which pinch the container together locally and simultaneously such that more than two separate liquid chambers are formed, each of which containing a desired dose of said product for administration to a patient, and said product is thereafter withdrawn from each of said liquid chambers as desired.

9. The method of claim 8, characterized in that the solid support is also provided with spaced projections, which match those of the plate.

10. The method of claim 8, characterized in that the tubular container is initially divided into two or more spaces, in each of which is enclosed a product constituents, and that said spaces are subsequently united and their constituents mixed before said container is pinched together to form the liquid chambers.

11. The method of claim 8, characterized in that the liquid is withdrawn from a liquid chamber by introducing a pointed tube through the wall of said liquid chamber.

12. The method of claim 11, characterized in that said pointed tube is in liquid connection with an injection needle, such that said dosing is carried out as an injection.

13. The method of claim 8, characterized in that the liquid chamber from which liquid is withdrawn is squeezed to squeeze said liquid out from said liquid chamber.

* * * * *